US005241940A

United States Patent [19]

Gates, Jr.

[11] Patent Number: 5,241,940

[45] Date of Patent: Sep. 7, 1993

[54] AUTOMOTIVE EGR SYSTEM

[75] Inventor: Freeman C. Gates, Jr., Southfield, Mich.

[73] Assignee: Ford Motor Company, Dearborn, Mich.

[21] Appl. No.: 1,594

[22] Filed: Jan. 7, 1993

[51] Int. Cl.[5] ..... F02M 25/07

[52] U.S. Cl. ..... 123/568; 123/570; 123/571

[58] Field of Search ..... 123/568, 569, 570, 571; 60/278

[56] References Cited

U.S. PATENT DOCUMENTS

| | | | |
|---|---|---|---|
| 3,412,722 | 11/1968 | Epifanio, Sr. | 123/570 |
| 3,618,576 | 11/1971 | Dixon | 123/570 |
| 3,648,672 | 3/1972 | Muroki et al. | 123/570 |
| 3,775,976 | 12/1973 | Karig | 60/39.33 |
| 3,786,635 | 1/1974 | Kates et al. | 60/278 |
| 3,871,343 | 3/1975 | Nagai et al. | 123/570 |
| 3,877,447 | 4/1975 | Ross, Sr. | 123/570 |
| 4,055,158 | 10/1977 | Marsoe | 123/570 |
| 4,259,099 | 3/1981 | Akabane et al. | 123/568 X |
| 4,267,809 | 5/1981 | Mase et al. | 123/568 X |
| 4,356,806 | 11/1982 | Freesh | 123/570 |
| 4,373,495 | 2/1983 | Bradshaw | 123/568 |
| 4,398,525 | 8/1983 | Ahrns et al. | 123/568 |
| 4,399,798 | 8/1983 | Stoltman | 123/568 X |
| 4,434,776 | 3/1984 | Shirase et al. | 123/568 |
| 4,467,774 | 8/1984 | Becker et al. | 123/568 |
| 4,475,525 | 10/1984 | Fukae | 123/568 |
| 4,503,813 | 3/1985 | Lindberg | 123/25 E |
| 4,696,279 | 9/1987 | Lindberg | 123/570 |

*Primary Examiner*—Willis R. Wolfe

*Attorney, Agent, or Firm*—Jerome R. Drouillard; Roger L. May

[57] ABSTRACT

An automotive exhaust gas recirculating (EGR) system contains a pressure sensor responsive to the changes in exhaust manifold gas pressure to control the movement of an EGR valve. A water vapor/ice condenser is installed in the exhaust gas signal line to the pressure sensor so that any water vapor/ice present in the exhaust gas will be condensed/precipitated out and not cause a malfunction of the pressure sensor and an erroneous output signal.

16 Claims, 1 Drawing Sheet

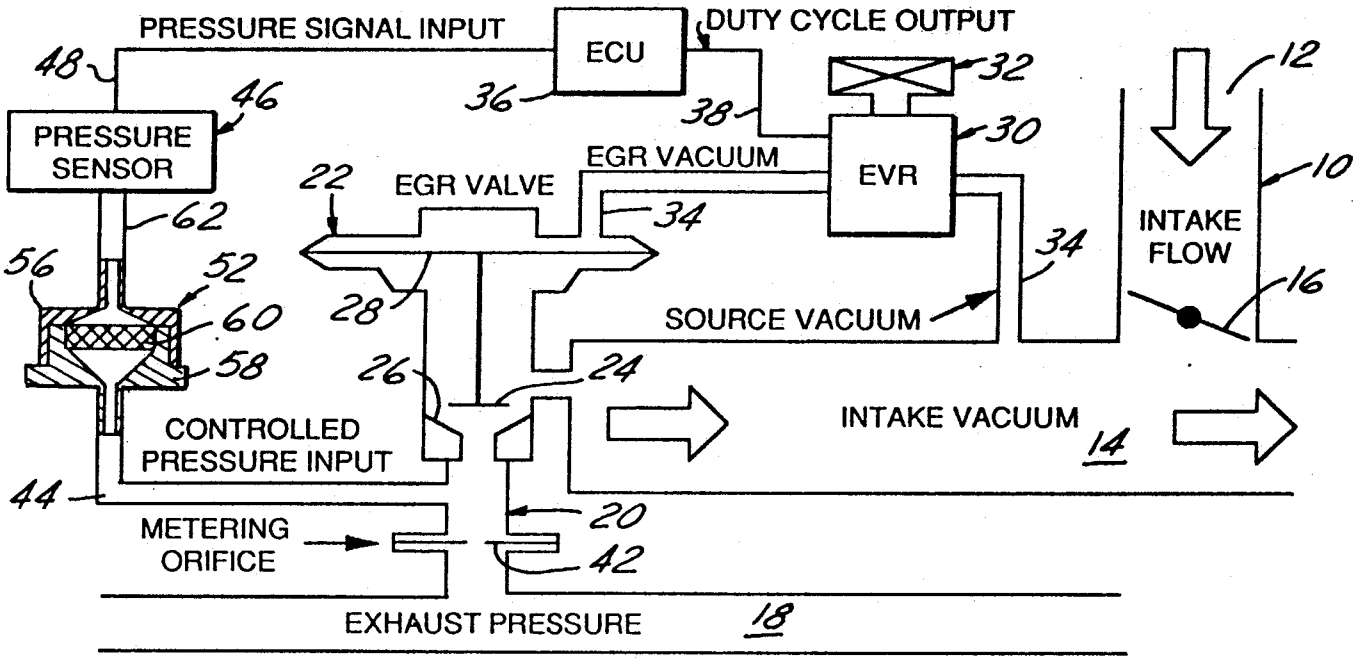
FIG. 1
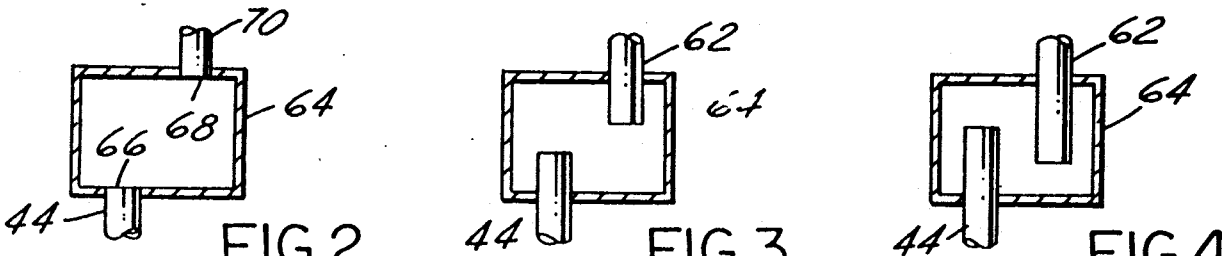
FIG. 2
FIG. 3
FIG. 4

AUTOMOTIVE EGR SYSTEM

FIELD OF THE INVENTION

This invention relates in general to an automotive type exhaust gas recirculation (EGR) system. More particularly, it relates to a mechanism for preventing icing and malfunction of a pressure sensor forming part of the EGR system.

BACKGROUND OF THE INVENTION

Many of the automotive EGR systems in use today use exhaust gas back pressure sensitive EGR systems. That is, the changes in exhaust pressure, the intake manifold vacuum, and the position of the EGR valve are monitored partially by means of pressure sensors to control the movement of the EGR valve as a function of the changes in the various parameters as the engine operating conditions change.

Exhaust gases contain water vapor, among other impurities, that pass with the exhaust gases against the pressure sensor movable parts. In colder climates, the water vapor turns to ice causing the pressure sensor to malfunction, which then may cause the EGR valve not to operate as scheduled to provide control of the emissions, The end result is an erroneous output from the sensor, with a very high replacement rate of the pressure sensors in the field.

The invention provides the ability to isolate an EGR pressure sensing device, either electrical or mechanical, from water condensation found in the exhaust gases.

DESCRIPTION OF THE PRIOR ART

The prior art does not, in any respect show the use of a deicer in an exhaust gas pressure line to a pressure sensor located in an EGR system, nor is it obvious in view of the prior art to do so. Water separators or condensers used in connection with EGR systems are known in general. However, in substantially all instances, the water separators are used just to cool and condense or purge the water vapor from the gases prior to their being readmitted to the engine. The basic philosophy of the prior art is merely to remove water vapor so that, in some cases, it can be readmitted as a spray into the engine for better fuel mixing, or in other instances to eliminate the water entirely. Nowhere is there a suggestion or concept of removing water vapor from the gas that is directed against a pressure sensing device to prevent icing of the components of the device and thereby prevent malfunction of the same.

U.S. Pat. No. 3,412,722, Epifanio, Sr., describes an automotive type exhaust treatment system in which a portion of the exhaust gases are directed through a condensation chamber 35 to condense the vapors and thereby allow the filter to better filter out impurities left in the remaining gases, which then pass through mufflers. The condensation chamber 35 is for treating the exhaust gases, not for deicing the gases.

U.S. Pat. No. 3,618,576, Dixon, describes an engine EGR system wherein the gaseous products of combustion are recycled, including a pair of cooler-condensers, first condensing water to remove it from the system and then condensing the remaining gases to return them as such to the inlet of the engine for use.

U.S. Pat. No. 3,648,672, Muroki et al., shows in FIG. 1 a system for purifying the exhaust gases of an internal combustion engine, including a cooling chamber 13 surrounding a portion of the intake manifold and a drain 15, for cooling and condensing and draining moisture out of the exhaust gas.

U.S. Pat. No.3,775,976, Carig, describes an underwater thermo propulsion system that includes a water cooled condenser 20 and a water separator 23, with a drain 24 for pumping water vapor from the exhaust gases so they can be reused in the engine 10. The separator 23 contains sintered metal of controlled porosity. The purged vapors are then fed to the liquid oxygen container housing.

U.S. Pat. No. 3,786,635, Kates et al., describes an engine EGR system including the use of a condenser 14 with cooling coils 84 for removing water from the exhaust gases before a portion of the gases are returned to the engine for reuse.

U.S. Pat. No. 3,871,343, Nagai et al., utilizes a gas-water separator 6 in an EGR system, wherein the gases are first cooled in a cooler 4 and then sprayed from a sprayer 70 to condense the water vapor, and then passed through the water separator 6 before being recycled to the engine.

U.S. Pat. No. 3,877,447, Ross, Sr., describes an automotive EGR system including a vapor trap 26 for removing water vapor from the exhaust gases passing through a water cooled muffler 12 prior to entering the engine air/exhaust mixing chamber 28 for recycling.

U.S. Pat. No. 4,055,158, Marsoe, descricribes an automotive EGR system in which an exhaust gas branch 5A passes exhaust gases first through a liquid cooled heat exchanger 8, and then to a condensate trap 9. It is stated that the condensate trap is not a required element since it is the cooling of the exhaust that will affect the lowering of $NO_x$ emissions.

U.S. Pat. No. 4,356,806, Freesh, describes an automotive EGR system in which a portion of the exhaust gases are diverted to reduce emissions for reuse in the engine, the portion diverted being treated primarily to prevent vapor lock-backfiring under cool and warm weather conditions. The diverted portin in line 30 is first cooled as it passes fins 40, then is passed through filters 41 and 42 containing porus filter material 50, that breaks up but does not remove the water droplets, and then distributes them more evenly throughout the exhaust gases so that the mixture can be better atomized into the engine through the PVC line.

U.S. Pat. No. 4,467,774, Becker et al., shows an engine EGR system including an EGR line 18 and an EGR valve 20, and a second line 22 downstream of the EGR line at a lower pressure level (vacuum), as a result of being connected to a venturi 23 to remove any condensate/water vapor formed in the exhaust gas in line 18 when valve 20 is closed.

U.S. Pat. No. 4,503,813, Lindberg, describes an EGR system for injecting water into the engine in whcih a water condenser 40 is used to condense some of the water vapor out of the exhaust gas into a trap 41 to add it as a liquid water to the fuel for better combustion.

U.S. Pat. No. 4,696,279, Lindberg, describeds a side stream of exhaust gas being cooled and centrifuged to condense water vapor out of it, then the reuse of the water by later reintroducing it into the engine as liquid water for better combustion of the fuel.

SUMMARY OF THE INVENTION

The invention is directed primarily to means for removing the water vapor/ice crystals from the exhaust gas of an automotive type engine that is directed against a pressure sensor that controls a portion of the operation of the exhaust gas recirculating system for the engine. The output of the sensor controls the movement of the EGR valve. In colder climates, the water vapor in the exhaust gas signal line can freeze against the components of the pressure sensor, causing a malfunction and an erroneous signal output. This leads to replacement of the sensor means.

The invention provides a water separator/condenser that removes the water vapor from the exhaust gas prior to the gas entering the pressure sensor.

It is, therefore, a primary object of the invention to provide an automotive EGR system with the ability to isolate an EGR pressure sensing device from water condensation found in the engine exhaust gases, thereby eliminating the need for replacement of the sensing device under icing conditions.

Other objects, features, and advantages of the invention will become more apparent upon reference to the succeeding, detailed description thereof and to the drawings illustrating the preferred embodiments thereof.

DESCRIPTION OF THE DRAWINGS

FIG. 1 schematically illustrates an EGR system embodying the invention, with portions broken away and in section.

FIGS. 2, 3, and 4 illustrates modifications of a detail of FIG. 1.

DESCRIPTION OF THE PREFERRED EMBODIMENT

FIG. 1 illustrates, in general, a known automotive engine exhaust gas recirculation (EGR) system. It includes an air throttle body 10, open to intake air at ambient pressure at its upper end 12, and connected to the engine intake manifold 14 at its lower end. A throttle valve 16 is rotatively mounted in the throttle body for controlling the air intake flow in a known manner. The system includes an exhaust manifold, not shown, having a branch exhaust passage 18, connected to the intake manifold vacuum passage 14 by a further interconnecting passage 20. An EGR assembly valve 22 has an EGR valve 24 movable in passage 20 towards and away from a seat 26 to control the flow of exhaust gases from passage 18 into the intake manifold. The EGR valve assembly contains a diaphragm 28 movable by vacuum in one direction and by a spring, not shown, in the opposite direction to control the regulating movement of the valve. EGR vacuum for actuating the EGR valve is controlled in this case by an electronic vacuum regulator (EVR) 30 that is operated by a solenoid 32 to control the flow of source vacuum in a line 34 tapped from the intake manifold as shown. While an electronic control is shown, it will be clear that a mechanical system could alternatively be used as well. The electronic vacuum regulator 30 moves either to vent vacuum from the EGR valve assembly 22 to allow the spring to close the valve, or applies vacuum to the diaphragm 28 to open the valve. The operation of solenoid 32 is controlled by an on-board electronic computer (ECV) 36 having, for example, a 12 volt electrical duty cycle output signal in line 38 to solonoid 32.

The branch exhaust line 20 contains a metering orifice 42 that provides a pressure differential on opposite sides for control purposes to regulate the movement of the EGR valve in the system being described. Downstream of metering orifice 42 is provided a control pressure exhaust gas input line 44 that is connected to a pressure sensor 46. The latter, in this particular case, is a transducer, or more specifically, a ceramic capacitive type gage pressure sensor. While this specific type of pressure sensor is described, it will be clear that other suitable pressure sensors, mechanical or electrical, can be used without departing from the scope of the invention.

In this particular case, the capacitance of the sensor 46 changes as a function of changing the height of a ceramic diaphragm as the pressure in the exhaust gases changes. These changes are then transmitted as a corresponding signal voltage through an electrical pressure signal input line 48, to the ECU computer/microprocessor 36. The ECU can then compare the pressure signal in line 48 to a design schedule for the particular operating conditions of the engine to provide a movement of the EGR valve in a manner supplying the engine with the desired flow volume for those particular engine operating conditions.

Turning now to the invention, as stated previously, the exhaust gases contain water vapor. Under cold weather operating conditions, the water vapor can turn to ice resulting in icing of the delicate movable operating components of pressure sensor 46, since the exhaust gas is directed directly against these components. Without a means to remove this water vapor or deice the exhaust gas prior to entering the pressure sensor, the pressure sensor can manfunction and send an erroneous signal through line 48 to the computer. The result usually is a necessary replacement of the pressure sensor itself at a cost.

The invention eliminates both the malfunction and need for replacing the pressure sensor. More particularly, FIG. 1 shows a water/ice separator 52, having an outer housing consisting of two hollow nested portions 56 and 58. Within the housing is located an annular filter 60 consisting of sintered metal particles, such as crimped aluminum, having a controlled porosity permitting the passage of gas through it, but not water vapor. The two parts of the housing are connected, respectively, to the exhaust gas inlet signal line 44, and a second line 62 connected to the pressure sensor. As the gas passes through the filter 60, the water vapor therein condenses on the cold metal particles, allowing the moisture free exhaust gas to continue on to the pressure sensor 46.

FIGS. 2, 3, and 4 show various other configurations usable to precipitate out the water vapor/ice crystals from the exhaust gas. FIG. 2 shows a hollow, closed housing 64 with expansive interior volume providing a large surface area upon which the water vapor can be deposited. It has an inlet 66 laterally offset from an outlet 68, the inlet being connected to the gas inlet line 44, and the outlet being connected to an outlet tube 70 connected to line 62 and the pressure sensor 46.

FIG. 3 shows the housing 64 in this case with the inlet and outlet tubes projecting inwardly and opening towards one another in a facing manner but offset laterally and longitudinally from one another.

FIG. 4 shows the tubes as extending further into the housing in a manner to overlap one another.

In each of the above cases, the exhaust gas enters the chamber and the water vapor/ice is condensed/deposited on the large surface area of the walls of the housing, the gas moving in a circuituous or labyrnthian-like path before exiting the housing to better expose the vapor to the walls, thereby assuring the maximum containment of water vapor in the housing. The tubes in this case being essentially parallel and laterally and longitudinally spaced from each other provide a controlled circulatory space between the open ends that face one another.

In the above cases of FIGS. 1 and 2, the water condensed out of the system can drain back into the inlet line 44. In the FIGS. 3 and 4 cases, a separate drain can be provided from the housing 64, as desired.

Details of construction and operation of the EGR system, per se, other than those described above, are not given since they are known and believed to be unnecessary for an understanding of the invention.

While the invention has been shown and described in its preferred embodiments, it will be clear to those skilled in the art to which it pertains, that many changes and modifications may be made thereto without departing from the scope of the invention.

I claim:

1. An (EGR) system for an automotive type engine having intake and exhaust manifolds and an EGR passage connecting the manifolds for recirculating a portion of exhaust gases into the engine, the system including an EGR valve in the passage movable between positions opening and closing the passage, electronic control means for controlling the operation of the valve, exhaust gas pressure sensor means operably connected to the control means for delivering a signal thereto indicative of a change in the pressure of the exhaust manifold gases adjacent the EGR valve, second signal passage means operatively connecting the sensor means to the exhaust gases adjacent the EGR valve, and water separator means in the second passage for condensing water vapor from the exhaust gases prior to connection to the sensor means to prevent icing of the sensor means.

2. An EGR system as in claim 1, wherein the separator means comprises a housing having sintered metal filtering means therein in the path of flow of the gases providing a restriction to the flow of gases therepast and effecting condensation thereon of the water vapors in the gases.

3. An EGR system as in claim 1, wherein the separator means comprises a housing containing crimped aluminum wire providing a restriction to flow of the gases and a large surface area for deposition of the water vapor.

4. An EGR system as in claim 1, wherein the separator means comprises a hollow closed housing having a pair of gas flow tubes projecting thereinto from opposite directions with the adjacent open ends facing one another but laterally and longitudinally spaced from one another to provide a labyrinthian-like passage between the two for the flow of gas, means connecting one of the tubes to the second passage and the other tube to the sensor means, the spacing effecting the flow of gas into the housing from the one tube for the deposition of water vapor in the gas thereagainst and thereon, and therefrom in a tortuous path into the other tube for the passage of moisture free gas to the sensor means.

5. An EGR system for an automotive type engine having intake and exhaust manifolds and an EGR passage connecting the manifolds for recirculating a portion of exhaust gases into the engine to control the output of emissions, the system including an EGR valve in the passage movable between open and closed positions for regulating the amount of EGR gases passing into the intake manifold, means connecting the intake manifold vacuum to the EGR valve to move the same, vacuum regulator means operative to regulate the vacuum flow to the valve, flow orifice means in the passage between the exhaust manifold and the valve providing a differential pressure signla upon changes in the exhaust gas pressure and the position of the valve, gas pressure sensing means operatively connected to the EGR passage between the orifice means and the valve for sensing changes in the exhaust gas pressure sensing mans and vacuum control means indicative of the EGR system operating conditions for delivery of an output signal to the vacuum control means for controlling movement of the EGR valve, and water vapor separating means in the connection to the sensor means for condensing water vapor out of the exhaust gases prior to entering the sensor means to prevent icing and malfunction of the sensor means.

6. An EGR system as in claim 5, wherein the separator means comprises a hollow housing having sintered metal filtering means therein in the path of flow of the gases providing a restriction to the flow of gases therepast and a large surface area for effecting condensation thereon of the water vapors in the gases.

7. An EGR system as in claim 5, wherein the separator means comprises a housing containing crimped aluminum wire providing a restriction to flow of the gases and a large surface area for deposition of the water vapor thereon.

8. An EGR system as in claim 5, wherein the separator means comprises a hollow housing having a pair of gas flow tubes projecting thereinto from opposite directions with the adjacent open ends facing one another but laterally and longitudinally psaced from one another to provide a labyrinthian-like passage between the two for the flow of gas, means connecting one of the tubes to the second passage and the other tube to the sensor means, the spacing effecting the flow of gas into the housing form the one tube for the deposition of water vapor in the gas thereagainst and thereon, and therefrom in a tortuous path into the other tube for the passage of moisture free gas to the sensor means.

9. An exhaust gas recirculating (EGR) system for an automotive type engine having intake and exhaust manifolds and an EGR passage connecting the manifolds for recirculating a portion of exhaust gases into the engine, the system including an EGR valve in the passage movable between positions opening and closing the passage, means for moving the valve, pressure responsive sensor means operatively connected to the passage and to the valve responsive to the changes in exhaust manifold gas pressure for controlling movement of the valve, and water separating means in the connection between the sensor and passage operative to trap water vapor present in the gases to present icing of the sensor means by the contact of water vapor thereagainst.

10. An EGR system as in claim 9, wherein the pressure sensor is a ceramic capacitive type tauge pressure sensor.

11. An EGR system as in claim 9, wherein the pressure sensor is a transducer.

12. An EGR system as in claim 9, the connection including a sensor passage connecting the exhaust gases to the sensor means to act thereon.

13. An EGR system as in claim 12, the water separating means including a housing having an inlet connected to the second passage and an outlet connected to the sensor means, the housing containign sintered metal particles restricting the flow of gases therethrough and effecting the condensation of water vapor in the gases thereon.

14. An EGR system as in claim 12, the water separating means including a hollow housing defining a chamber and having an inlet tube connected to the second passage for the flow of exhaust gases into the housing, and an outlet tube connected to the sensor means, the inlet and outlet tubes extending into the housing in non-overlapping but laterally separated fashion to effect the precipitation of water vapor out of the exhaust gases against the wall of the housing, whereby moisture free exhaust gases are discharged therefrom to the sensor means.

15. An EGR system as in claim 12, the water separating means comprising a hollow housing having gas flow inlet and outlet tubes projecting thereinto from opposite ends thereof, the tubes being laterally and longitudinally separated to form a circuituous labyrinthian-like flow passage therebetween for effecting the deposition of water vapor in the gases in the housing prior to discharge of the moisture free gases throug the outlet to the sensor means.

16. An EGR system as in claim 12, the water separating means comprising a hollow housing having a pair of laterally and longitudinally offset parallel tubes extending into the housing in opposite directions towards one another, the tubes being connected one to the second passage and the other to the sensor means, the adjacent ends of the tubes facing one another in offset fashion and together with the housing walls defining a tortuous path for the flow of exhaust gases between the tubes to effect condensation of the water vapor in the housing thereby purging the gases of the water vapor to effect passage of moisture free gas to the sensor means.

* * * * *